US007483517B2

(12) United States Patent
Barschdorf et al.

(10) Patent No.: US 7,483,517 B2
(45) Date of Patent: Jan. 27, 2009

(54) DEVICE FOR GENERATING X-RAYS HAVING A LIQUID METAL ANODE

(75) Inventors: Hans Barschdorf, Dassendorf (DE); Bernd R. David, Huettblek (DE); Axel Thran, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 282 days.

(21) Appl. No.: 10/599,792

(22) PCT Filed: Mar. 31, 2005

(86) PCT No.: PCT/IB2005/051078

§ 371 (c)(1),
(2), (4) Date: Oct. 10, 2006

(87) PCT Pub. No.: WO2005/101450

PCT Pub. Date: Oct. 27, 2005

(65) Prior Publication Data

US 2008/0285717 A1 Nov. 20, 2008

(30) Foreign Application Priority Data

Apr. 13, 2004 (EP) ..... 04101491

(51) Int. Cl.
*H01J 35/08* (2006.01)
*H01J 35/18* (2006.01)

(52) U.S. Cl. ..... 378/119; 378/143; 378/161

(58) Field of Classification Search ..... 378/119, 378/143, 161

See application file for complete search history.

(56) References Cited

U.S. PATENT DOCUMENTS 5,052,034 A * 9/1991 Schuster ..... 378/121
6,185,277 B1 * 2/2001 Harding ..... 378/143

(Continued)

FOREIGN PATENT DOCUMENTS

WO WO 03/077277 9/2003

*Primary Examiner*—Allen C. Ho

(57) ABSTRACT

The invention relates to a device for generating X-rays (18) comprising an electron source (3) for emitting electrons accommodated in a vacuum space (2), a liquid metal circuit including a liquid metal for emitting X-rays as a result of the incidence of electrons and a pumping means (11) for causing a flow of the liquid metal through a constriction (7) where the electrons emitted by the electron source (3) impinge upon the liquid metal, and a radiation window (12) bounding said constriction (7), which is transparent to electrons and X-rays and separates the constriction (7) from the vacuum space (2). To provide a device for generating X-rays in which a cross-sectional area of the constriction substantially corresponds to an intended, desired cross-sectional area due to a self-regulating process without the need for external or additional components or electronics, it is proposed that said constriction (7) being bounded by a compensation window (13) opposite of said radiation window (12), which separates the constriction (7) from a pressure chamber (14) containing liquid metal provided by said liquid metal circuit via a connection (15), and which, during operation, has a profile (p') as a result of a deformation caused by a pressure in the pressure chamber (14) different from the pressure in the constriction (7) which substantially matches a profile (p) which the radiation window (12) has, during operation, as a result of a deformation of the radiation window (12) caused by a pressure of the liquid metal in the constriction (7).

6 Claims, 2 Drawing Sheets

Figure 1:
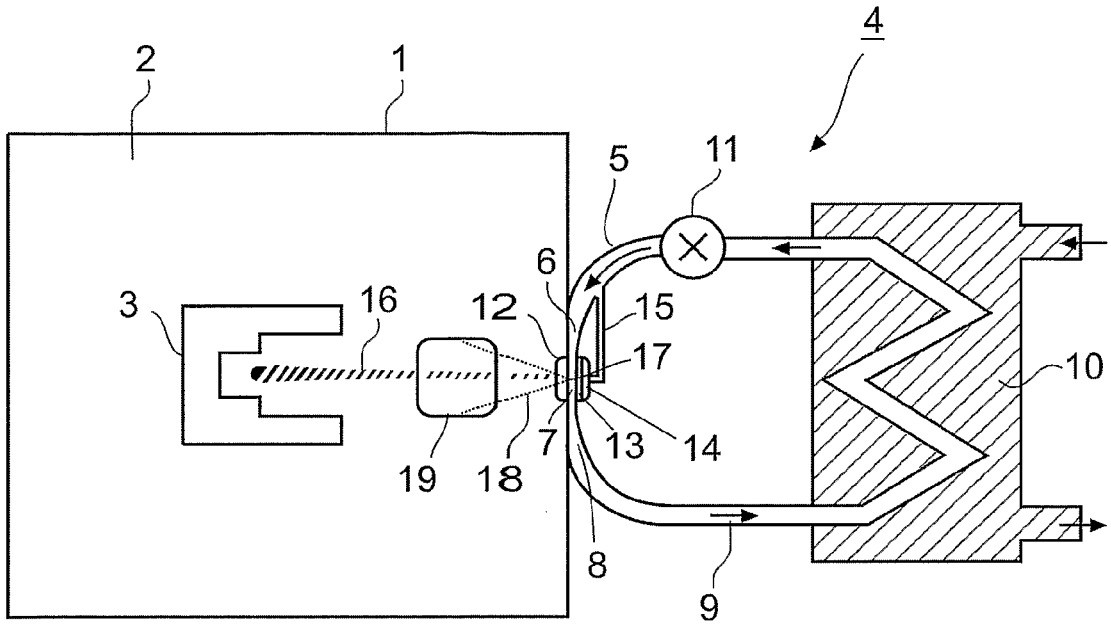

U.S. PATENT DOCUMENTS 6,477,234 B2 * 11/2002 Harding et al. ..... 378/141
6,560,313 B1 * 5/2003 Harding et al. ..... 378/143
6,647,094 B2 * 11/2003 Harding et al. ..... 378/143
6,925,151 B2 * 8/2005 Harding et al. ..... 378/119
6,961,408 B2 * 11/2005 Harding et al. ..... 378/143
7,127,036 B2 * 10/2006 Harding et al. ..... 378/139
7,412,032 B2 * 8/2008 Harding ..... 378/125
2004/0174957 A1 * 9/2004 Harding et al. ..... 378/143

* cited by examiner

DEVICE FOR GENERATING X-RAYS HAVING A LIQUID METAL ANODE

The invention relates to a device for generating X-rays comprising an electron source for emitting electrons accommodated in a vacuum space, a liquid metal circuit including a liquid metal for emitting X-rays as a result of the incidence of electrons and a pumping means for causing a flow of the liquid metal through a constriction where the electrons emitted by the electron source impinge upon the liquid metal, and a radiation window bounding said constriction, which is transparent to electrons and X-rays and separates the constriction from the vacuum space.

A device for generating X-rays of the kind mentioned in the opening paragraph is known from WO 03/077277 A1. In this device the constriction is bounded by a thin radiation window, which is made from a material which is transparent to electrons and X-rays and which separates the liquid metal in the constriction from the vacuum space, and by a wall opposite to the radiation window. The wall has a profile which matches a profile which the radiation window has, during operation, as a result of a deformation of the radiation window caused by a pressure of the liquid metal in the constriction. Thus, it is achieved that the constriction has a predetermined intended cross-sectional area, and a decrease of the flow velocity and an accompanying excessive increase of the pressure at the location of the deformation of the window are prevented.

WO 03/077277 A1 further describes methods to decrease the deformation of the radiation window, which is relatively thin to achieve sufficient transparency for electrons and X-rays, either by reducing the pressure of the liquid metal on the radiation window or by providing the window with corrugations for a better stability. The methods for reducing the pressure are based on either a fixed or a flexible profile given to the wall of the constriction opposite of the radiation window. Said flexible profile can be changed during operation by means of at least one actuator.

A disadvantage of the known device with said flexible profile is that there is a need for at least one pressure sensor and a control member for controlling the actuator as a function of a pressure by means of the sensor.

It is an object of the invention to provide a device for generating X-rays of the kind mentioned in the opening paragraph in which a cross-sectional area of the constriction substantially corresponds to an intended, desired cross-sectional area due to a self-regulating process without the need for external or additional components or electronics.

In order to achieve said object, a device for generating X-rays according to the invention is characterized in that said constriction is bounded by a compensation window opposite of said radiation window, which separates the constriction from a pressure chamber containing liquid metal provided by said liquid metal circuit via a connection, and which, during operation, has a profile as a result of a deformation caused by a pressure in the pressure chamber which substantially matches a profile which the radiation window has, during operation, as a result of a deformation of the radiation window caused by a pressure of the liquid metal in the constriction.

The invention is based on the insight that, since a deformation of the radiation window cannot be avoided because of the thinness of the radiation window needed for sufficient transparency to electrons and X-rays and because a vacuum is present at one side of the radiation window, the boundary of the constriction opposite of the radiation window has to have an adjusted profile. Since, according to the invention, said boundary is formed by a compensation window which has, during operation, a profile which substantially matches the profile of the radiation window and is caused by a pressure of liquid metal in the pressure chamber different from the pressure in the constriction, it is achieved without the need of external or additional components or electronics that a cross-sectional area of the constriction in the deformed state of said windows, i.e. during operation, substantially corresponds with an intended, desired cross-sectional area, which the constriction would have if the windows were not subject to deformation.

It is noted that the expression "matches" in claim 1 is not meant to be limited to "is identical to" or "corresponds with". Accordingly, the invention does not only cover embodiments in which, during operation, the constriction has a constant cross-sectional area, seen in a flow direction of the liquid metal, but also embodiments in which, during operation, the constriction has a cross-sectional area which changes in a predetermined intended manner in the flow direction. Therefore, the expression "matches" generally intends to indicate that the profile of the compensation window opposite to the radiation window is determined by, approximates, or corresponds with the profile of the deformed radiation window in such a manner that the cross-sectional area of the constriction in the deformed state of said windows, i.e. during operation, substantially corresponds with, and accordingly also might change, seen in the flow direction, in a manner corresponding with an intended cross-sectional area, which the constriction would have if the windows were not subject to deformation.

A particular embodiment of a device according to the invention is characterized in that said pressure chamber is connected to a high pressure area of said liquid metal circuit upstream of the constriction. In this embodiment the pressure in the pressure chamber imposed on the compensation window relates to the pressure provided by the pumping means and is not affected by a pressure loss downstream of the constriction caused by viscous flow losses. If the difference between the pressure in the constriction and the pressure in the pressure chamber is much greater than the pressure in the constriction there is virtually no influence of pressure changes in the constriction on the deformation of the compensation window.

In a preferred embodiment a device according to the invention is characterized in that said pressure chamber ranges substantially over the complete area of the compensation window. In this embodiment substantially the complete area of the compensation window is exposed to the pressure in the pressure chamber as the area of the radiation window is subject to the pressure in the constriction.

A beneficial embodiment of a device according to the invention is characterized in that said compensation window is substantially of the same size as the radiation window. In this embodiment the respective deformations of the windows will be similar when comparable pressures are applied.

A further embodiment of a device according to the invention is characterized in that said compensation window is substantially made of the same material as the radiation window. In this embodiment the respective deformations of the windows will be similar when comparable pressures are applied. Preferably the windows are made of tungsten, molybdenum or diamond.

A yet further embodiment of a device according to the invention is characterized in that said compensation window is thicker than the radiation window. In this embodiment the pressure in the pressure chamber is higher than the pressure in the constriction and since the difference between the pressure in the constriction and the pressure in the pressure chamber is much greater than the pressure in the constriction there is virtually no influence of pressure changes in the constriction on the deformation of the compensation window.

Figure 2:
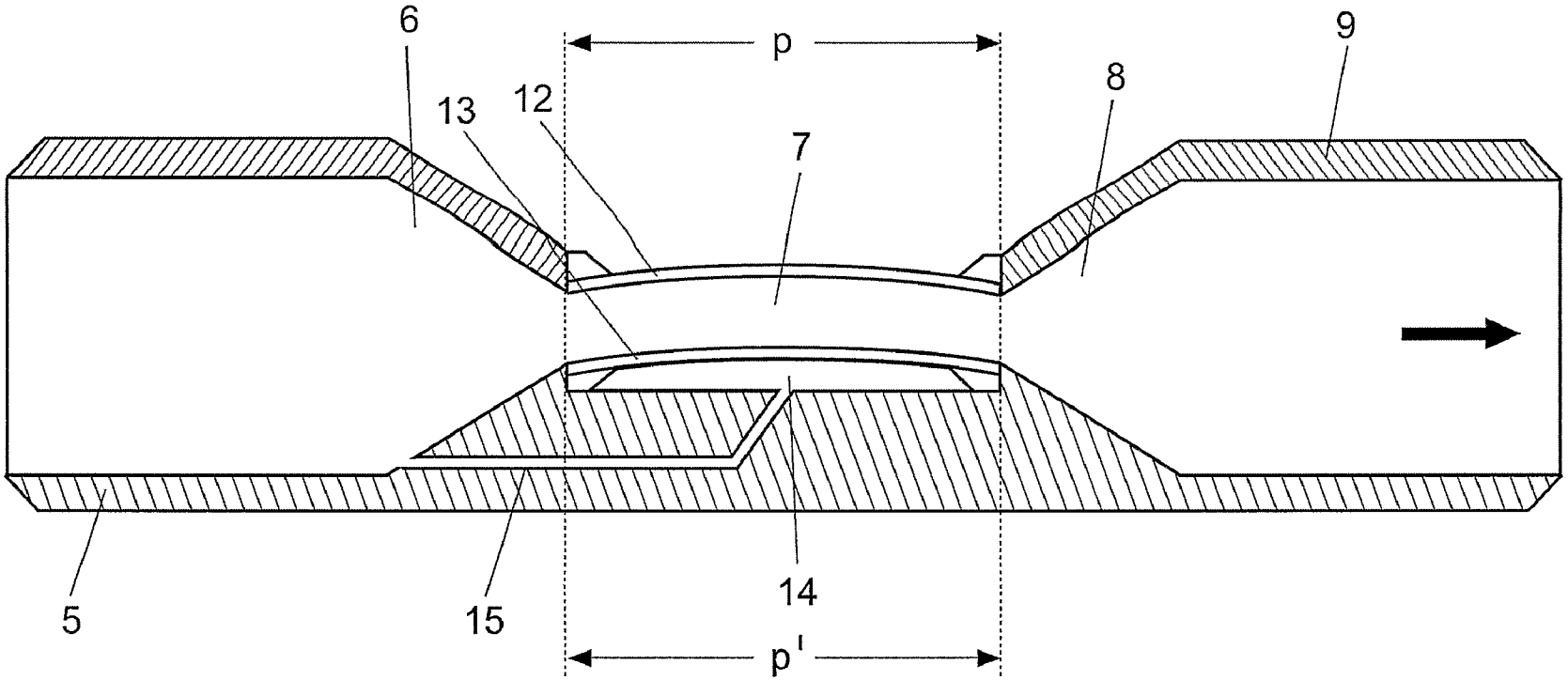

In the following, embodiments of a device for generating X-rays according to the invention will be explained further in detail with reference to the Figures, in which FIG. 1 schematically shows an embodiment of a device for generating X-rays according to the invention; and FIG. 2 shows a constriction of the device of FIG. 1 in detail.

In FIG. 1 only the main components of an embodiment of a device for generating X-rays according to the invention are schematically shown. The device comprises a housing 1 which encloses a vacuum space 2 in which a electron source 3 or cathode for emitting electrons is accommodated. The device further comprises a closed channel system 4 comprising an inlet channel 5, a converging part 6, a constriction 7, a diverging part 8, an outlet channel 9, a heat exchanger 10, and a hydraulic pump 11. The channel 4 is filled with a liquid metal which has the property of emitting X-rays as a result of the incidence of electrons and thus a liquid metal circuit is formed. In the embodiment shown, the liquid metal is an alloy of Ga, In, and Sn, but also other kinds of metals or metal alloys which are preferably liquid at room temperature, such for example Hg, may be used.

The constriction 7 is bounded by a radiation window 12, which is transparent to electrons and X-rays, and by a compensation window 13 opposite to the radiation window 12. In the embodiment shown, the radiation window 12 comprises a relatively thin (5 μm) diamond plate, but also other kinds of material which are sufficiently transparent to electrons and X-rays, such as for example Mo, may be used. The radiation window 12 separates the constriction 7 from the vacuum space 2, thereby preventing the vacuum space 2 from being contaminated by particles of the liquid metal. The compensation window 13 separates the constriction 7 from the pressure chamber 14 containing liquid metal provided by the channel system 4 via a connection 15.

During operation of the device, the liquid metal is caused to flow through the constriction 7 by means of the hydraulic pump 11. In the embodiment shown, the hydraulic pump 11 is of a conventional type, but also another suitable pumping means may be used instead, such as for example a magnetohydraulic pump. The constriction 7 has a relatively small cross-sectional area, so that the flow of the liquid metal in the constriction 7 has a relatively high velocity and is turbulent. The electron source 3 generates an electron beam 16 which passes through the radiation window 12 and impinges upon the liquid metal in an impingement position 17 in the constriction 7. As a result of the incidence of the electron beam 16 upon the liquid metal, X-rays 18 are generated in the impingement position 17. Thus, the liquid metal in the constriction 7 constitutes an anode of the device for generating X-rays. The X-rays 18 emanate through the radiation window 12 and through an X-rays exit window 19, which is provided in the housing 1.

A further result of the incidence of the electron beam 16 upon the liquid metal is the generation of a large amount of heat in the impingement position 17. This heat is transported away from the impingement position 17 in an effective manner by the flow of the liquid metal in the constriction 7, and the heated liquid metal is subsequently cooled down again in the heat exchanger 10. In this manner, excessive heating of the liquid metal in the impingement position 17 and of the surroundings of the constriction 7 is prevented. By means of the flow of the liquid metal in the constriction 7, a relatively high rate of heat transport away from the impingement position 17 is achieved, so that a relatively high energy level of the electron beam 16 and consequently a relatively high energy level of the X-ray 18 is allowed.

FIG. 2 shows an enlarged part of the device shown in FIG. 1. Due to the pressure provided by the pumping means (not shown in FIG. 2) the liquid metal flows through the inlet channel 5, the converging part 6, the constriction 7, the diverging part 8 and the outlet channel 9. The flow speed increases in the converging part 6 and so the static pressure of the liquid metal decreases according to the Bernoulli effect. The pressure in the constriction 7 leads to a deformation of the radiation window 12, which therefore has a profile p. Due to the pressure difference between the pressure in the constriction 7 and the pressure in the pressure chamber 14 the compensation window 13 is also deformed and therefore has a profile p', which substantially matches the profile p. FIG. 2 shows a pressure chamber 14 which is linked to the converging part 6 via a connection 15. In another embodiment the pressure chamber 14 is linked to the inlet channel 5.

In order to obtain a sufficiently high velocity of the liquid metal in the constriction 7 during operation, the pump 11 generates a relatively high pressure of the liquid metal. In the embodiment shown in FIG. 1, a pressure in the order of 50-60 bar is generated in the inlet channel 5 to obtain a flow velocity in the order of 50 m/s in the constriction 7. In the embodiment shown, the constriction 7 has a height, i.e. a distance between the radiation window 12 and the compensation window 13, of approximately 400 μm, a length in the flow direction of approximately 1.5 mm, and a width perpendicular to the flow direction of approximately 10 mm. As a result of the Bernoulli effect in the converging part 6, the pressure in the constriction 7 is in the order of 1 bar. As a result of the Bernoulli effect in the diverging part 8, the pressure in the outlet channel 9 is in the order of 40-45 bar, which is lower than the pressure in the inlet channel 5 as a result of viscous flow losses.

Under the influence of the pressure of the liquid metal in the constriction 7, the radiation window 12 is deformed. A deformation of the radiation window 12 cannot be avoided, because the radiation window 12 should be sufficiently thin to achieve sufficient transparency to electrons and X-rays, and because at the side of the radiation window 12 remote from the liquid metal a vacuum pressure is present. In the embodiment of FIG. 1, a maximal deformation in the middle of the radiation window 12 is in the order of 30 μm. As a result of the difference between the pressure in the constriction 7 and the pressure in the pressure chamber 14 the compensation window 13 is also deformed. In the embodiment shown the compensation window has a thickness of 30 μm and is made of tungsten. The pressure difference between the pressure in the constriction 7 and the pressure in the pressure chamber 14 is in the order of 50-60 bar and the maximal deformation of the compensation window 13 is substantially matches the deformation of the radiation window 12.

The pressure of the liquid metal upstream of the constriction 7 is ruling among other parameters for the pressure and velocity of the liquid metal in the constriction 7 as well as for the pressure of the liquid metal in the pressure chamber 14. Using this relationship provides a self-regulating process without the need for external or additional components or electronics, which ensures that the constriction 7 has an intended, desired cross-sectional area and therefore an excessive pressure or pressure changes affecting said radiation window 12 are reduced or even prevented.

The invention claimed is:

1. A device for generating X-rays (18) comprising:

an electron source (3) for emitting electrons accommodated in a vacuum space (2);

a liquid metal circuit including a liquid metal for emitting X-rays as a result of the incidence of electrons and a pumping means (11) for causing a flow of the liquid metal through a constriction (7) where the electrons emitted by the electron source (3) impinge upon the liquid metal; and a radiation window (12) bounding said constriction (7), which is transparent to electrons and X-rays and separates the constriction (7) from the vacuum space (2);

characterized in that said constriction (7) is bounded by a compensation window (13) opposite of said radiation window (12), which separates the constriction (7) from a pressure chamber (14) containing liquid metal provided by said liquid metal circuit via a connection (15), and which, during operation, has a profile (p') as a result of a deformation caused by a pressure in the pressure chamber (14) different from the pressure in the constriction (7) which substantially matches a profile (p) which the radiation window (12) has, during operation, as a result of a deformation of the radiation window (12) caused by a pressure of the liquid metal in the constriction (7).

2. A device as claimed in claim 1, characterized in that said pressure chamber (14) is connected to a high pressure area of said liquid metal circuit upstream of said constriction (7).

3. A device as claimed in claim 1, characterized in that said pressure chamber (14) ranges substantially over the complete area of said compensation window (13).

4. A device as claimed in claim 1, characterized in that said compensation window (13) is substantially of the same size as said radiation window (14).

5. A device as claimed in claim 1, characterized in that said compensation window (13) is substantially made of the same material as said radiation window (12).

6. A device as claimed in claim 1, characterized in that said compensation window (13) is thicker than said radiation window (12).

* * * * *